US006006503A

United States Patent [19]

Davison et al.

[11] Patent Number: 6,006,503

[45] Date of Patent: Dec. 28, 1999

[54] PACKAGING MACHINE WITH A STRIPPING DEVICE

[75] Inventors: Clive Davison; Malcolm Charles Kerry, both of Beeston; David Robert Seaward, Conventry, all of United Kingdom

[73] Assignee: Molins, PLC., Milton Keynes, United Kingdom

[21] Appl. No.: 08/930,541

[22] PCT Filed: Mar. 29, 1996

[86] PCT No.: PCT/GB96/00770

§ 371 Date: Feb. 2, 1998

§ 102(e) Date: Feb. 2, 1998

[87] PCT Pub. No.: WO96/32328

PCT Pub. Date: Oct. 17, 1996

[30] Foreign Application Priority Data

Apr. 1, 1995 [GB] United Kingdom ..... 9506876
Mar. 15, 1996 [GB] United Kingdom ..... 9605426

[51] Int. Cl.[6] ..... B65B 9/06

[52] U.S. Cl. ..... 53/551; 53/374.3

[58] Field of Search ..... 53/451, 551, 552, 53/554, 555, 374.3, 375.4

[56] References Cited

U.S. PATENT DOCUMENTS

| | | | |
|---|---|---|---|
| 2,915,866 | 12/1959 | Bartlo | 53/552 X |
| 2,956,383 | 10/1960 | Gausman | 53/552 X |
| 3,070,931 | 1/1963 | Zwight | 53/552 |
| 3,262,244 | 7/1966 | Cutler et al. | 53/551 |
| 3,668,815 | 6/1972 | Henry et al. . | |
| 3,849,965 | 11/1974 | Dominici | 53/551 |
| 4,757,668 | 7/1988 | Klinkel et al. | 53/551 X |
| 4,947,618 | 8/1990 | Schneider et al. | 53/552 |
| 5,031,386 | 7/1991 | Schneider | 53/551 |
| 5,203,145 | 4/1993 | Kammler et al. | 53/552 |
| 5,279,098 | 1/1994 | Fukuda | 53/552 X |
| 5,412,927 | 5/1995 | Miyazaki et al. | 53/552 |
| 5,575,137 | 11/1996 | Metz et al. | 53/552 |

FOREIGN PATENT DOCUMENTS 0 488 794 A2 6/1992 European Pat. Off. .

*Primary Examiner*—Linda Johnson
*Attorney, Agent, or Firm*—Antonelli, Terry, Stout & Kraus, LLP

[57] ABSTRACT

A vertical form fill and seal packaging machine has a pair of sealing jaws for forming horizontal seals across the tubular packaging material at regular intervals, and a stripping device comprising a pair of conveyors mounted separately from and at the side of the sealing jaws and carrying cooperating parallel stripping bars which are moved downwards by the conveyors, on opposite sides of the packaging material and ahead of engagement of the packaging material by the sealing jaws, to ensure that product being packaged drops down past the sealing jaws before the jaws act to form each seal.

23 Claims, 4 Drawing Sheets

PACKAGING MACHINE WITH A STRIPPING DEVICE

This invention is concerned with packaging machines of the type commonly referred to as vertical form fill and seal machines. In such machines, a web of packaging material is drawn along a former and then passes downwards in a tubular formation; the edges are then sealed longitudinally, after which horizontal seals are made at regular intervals to form individual packets. A measured quantity of product to be packaged is dropped into each packet before a top seal is formed by sealing jaws which simultaneously form the bottom seal of the next packet. The sealing jaws commonly include a cutting device which separates successive packets.

With some materials and in some circumstances, it is desirable to provide a stripping device to ensure that each measured quantity of the product passes downwards reliably into its packet before the top seal is formed. An example of a stripping device is described in European patent No. 165819. In that case cooperating stripping members are mounted on rotary sealing jaws and thus rotate at the same speed as the jaws. The present invention, on the other hand, allows stripping members to be driven at a greater speed than the sealing jaws while they are performing each stripping operation.

According to one aspect of the present invention, a packaging machine of the type described comprises a pair of sealing jaws for forming horizontal seals across the tubular packaging material at regular intervals, and a stripping device comprising a pair of conveyors mounted separately from and at the side of the sealing jaws (preferably at both sides) and carrying cooperating parallel stripping bars which are moved downwards by the conveyors, on opposite sides of the packaging material and ahead of engagement of the packaging material by the sealing jaws, to ensure that product being packaged drops down past the sealing jaws before the jaws act to form each seal. The reference to "the side of the sealing jaws" preferably applies to the position of the conveyor when viewed horizontally in a direction normal to the sealing surfaces of the jaws as they engage the packaging material.

In some packaging machines of this type it is also desirable to provide means to ensure that pieces of the product being packed do not fall into the seal area before the seal is formed. For that purpose the present invention may be adapted to provide, in addition to the stripping bars (or as an alternative), one or more pairs of product catching bars mounted on a pair of conveyors as described above. The product catching bars are brought close together by the conveyors carrying them, on opposite sides of the packaging material and in a region above the sealing jaws as they form each seal, to ensure that each quantity of product does not enter the bottom seal area before the seal is formed. The product catching bars may be carried by the same conveyors that carry the stripping bars, or by separate conveyors.

The term "bar" as used in this context embraces rollers which can rotate about their axes, as well as bars which are non-rotatably mounted on the corresponding conveyor or conveyors.

Catching or clamping bars carried by endless conveyors are disclosed in FR-A-2182006. The bars in that case have the purpose of preventing the weight of liquid (which is the product being packaged) bearing on each seal before it is securely formed.

This invention is particularly applicable to continuously moving packaging material and sealing jaws, the jaws being for example in a rotary form. However, it is in principle also applicable to machines based on horizontally reciprocating sealing jaws, the drive for the packaging material in this case being normally intermittent. In the case of continuous rotary-type sealing jaws, the path of the jaws may be such that the jaws remain in contact with the packaging material through a finite distance. Alternatively, in the simplest type of rotary arrangement the packaging material is only briefly engaged by the jaws while they are at about their 3 o'clock and 9 o'clock positions respectively; for the purpose of illustration, FIG. 1 and 2 of the attached drawings show a simple rotary sealing jaw arrangement in that form.

Each conveyor preferably comprises two belts or chains located on opposite sides of the sealing jaws and carrying sealing bars secured at their ends to the respective belts or chains.

According to another aspect of this invention, a vertical form fill and seal packaging machine comprises means for feeding tubular-formed packaging material between two rotary sealing members which cooperate to form horizontal seals at intervals along the packaging material between successive downward deliveries into the top opening of the packaging material of quantities of product to be packaged, characterised by a product control arrangement comprising a pair of cooperating parallel bars each of which is supported at least at one end by a carrier member mounted and driven separately from the sealing members and arranged to move the bar along a path extending downwards between the sealing members and upwards on the outside of the adjacent sealing member.

Examples of packaging machines according to this invention are shown diagrammatically in the accompanying drawings. In these drawings.

Figure 1:
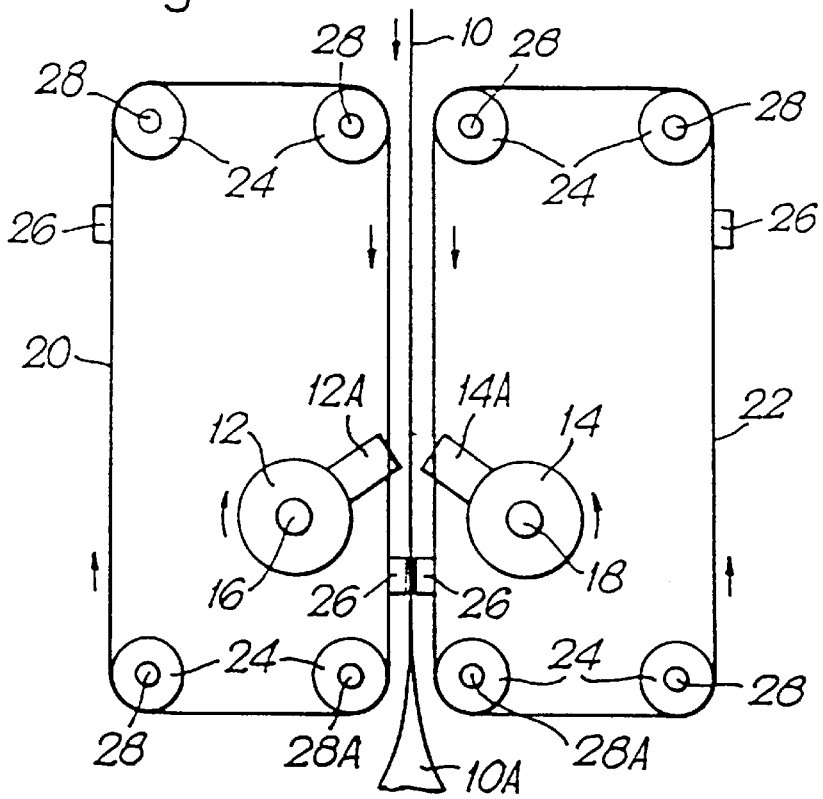
FIG. 1 is a front view of part of one machine.

FIG. 1 shows packaging material 10 moving downwards between rotary sealing members 12 and 14 which include heated sealing jaws 12A and 14A. At this stage the packaging material has had its longitudinal (vertical) edges sealed together, and the portion below the sealing jaws already contains product being packaged; accordingly, the lower portion 10A of the packaging material shown in FIG. 1 is in an expanded condition. The portion of the packaging material above the sealing jaws is shown flat (i.e. unexpanded) for the sake of simple illustration, but would in practice be in an expanded condition to provide space into which the next quantity of product will be dropped immediately after the sealing jaws have come together to form the next horizontal seal.

Each of the sealing members 12,14 is mounted on a shaft 16,18 and the opposite ends of the shafts are mounted in bearings 20. A drive (not shown) is connected to the right-hand end of each shaft to rotate the shafts at identical speeds so that the sealing jaws 12A, 14A come together to form seals across the packaging material at regular intervals.

Figure 2:
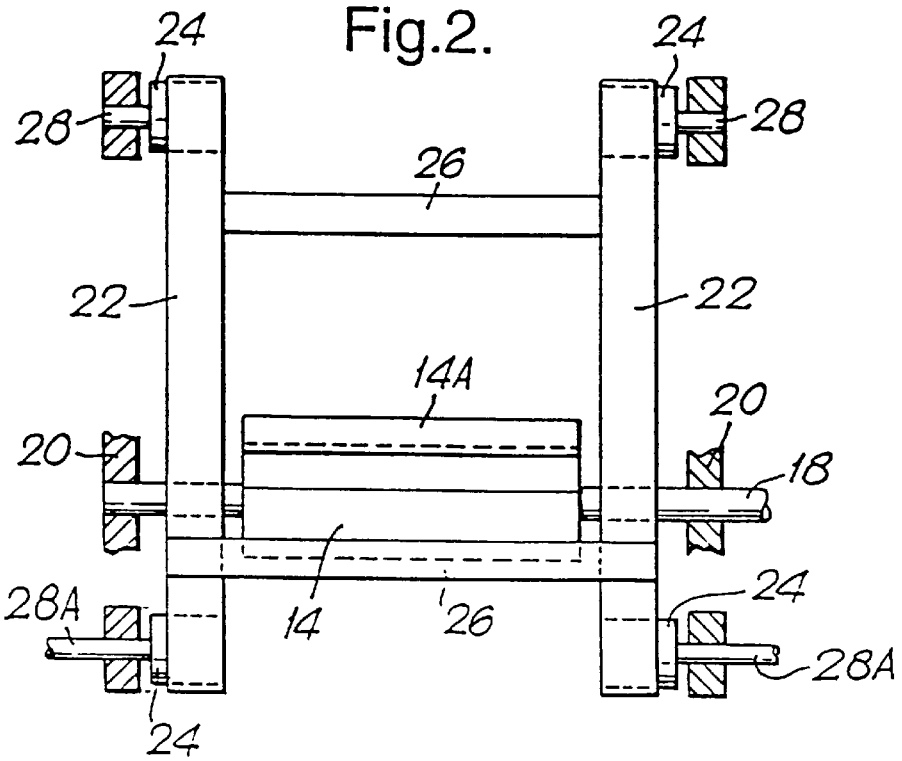
FIG. 2 is a plan, on a larger scale, of part of the machine.

A stripping device for the packaging machine comprises two pairs of belts 21,22 which pass around pulleys 24 and are located on opposite sides of the sealing jaws, as viewed in FIG. 2. Each pair of belts carries a number of stripping bars 26 of which the ends are secured to the respective belts.

The pulleys 24 are all mounted in cantilever fashion on shafts 28, one of the shafts 28A for each pulley being connected to a drive (not shown) whereby the belts are driven at the same speed (which fluctuates cyclically) and with appropriate timing with respect to the sealing jaws.

FIG. 1 shows the sealing jaws 12A,14A at positions at which they are about to engage the packaging material 10. Two of the stripping bars are shown in positions just below the sealing jaws, having moved downwards along parallel vertical paths in contact with the packaging material and just ahead of the sealing jaws to ensure that the product being packaged has dropped down below the corresponding sealing position. For this purpose, the stripping bars 26 are moved by the belts 22 at a speed slightly greater than that of the packaging material 10 at least during the downward-moving part of their cycle, and may then be driven more slowly during the remainder of their cycle.

A common drive motor may be provided for the sealing jaws and belts. Preferably, however, separate speed-controllable "servo" drive motors may be provided, with provision for electronic timing, these being commercially available systems; each motor in this case may be capable of modulating its speed so that the sealing intervals can be adjusted while ensuring that the sealing jaws have a peripheral speed equal to that of the packaging material while they are engaging the packaging material to form each seal, and that the cooperating stripping bars on opposite sides of the packaging material have engaged the packaging material and performed their stripping operation before the material is engaged by the sealing jaws.

Instead of the belts 22 each having four pulleys with their axes at the four corners of a rectangle, various different arrangements are possible. For example, the pulleys may be arranged to form a path for each belt which converges obliquely and linearly towards the packaging material before passing around a pulley from which the belts move vertically downwards.

As mentioned above, the belts 21,22 may also carry product catching bars. Alternatively, product catching bars similar to the stripping bars 26 may be carried by separate pairs of belts running adjacent to the belts 21,22 (at least while moving downwards) and driven by a separate servo motor so that the speeds of these separate belts can be suitably modulated to enable the product catching bars to perform their desired operations.

Figure 3:
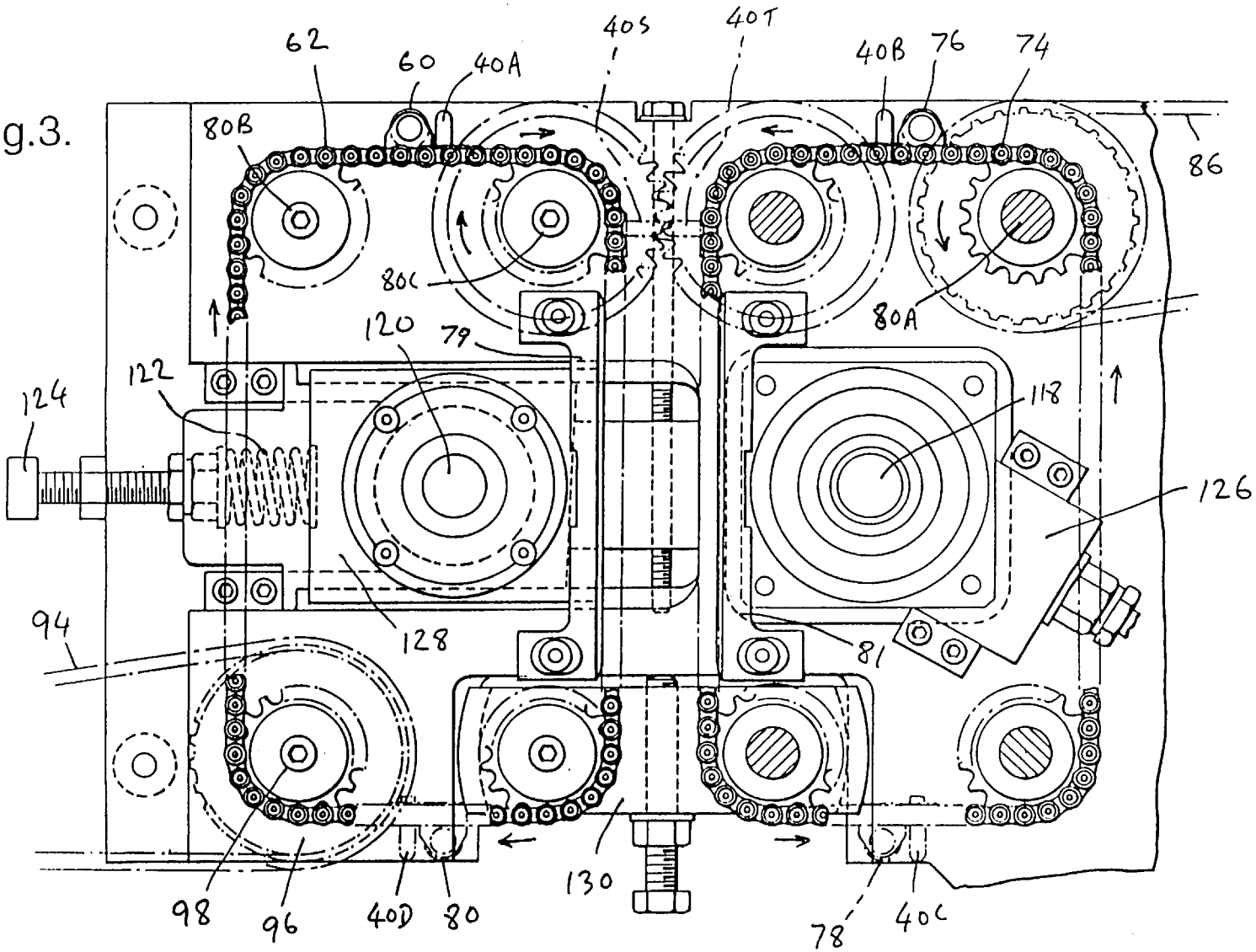
FIG. 3 is a front view of a different machine.
Figure 4:
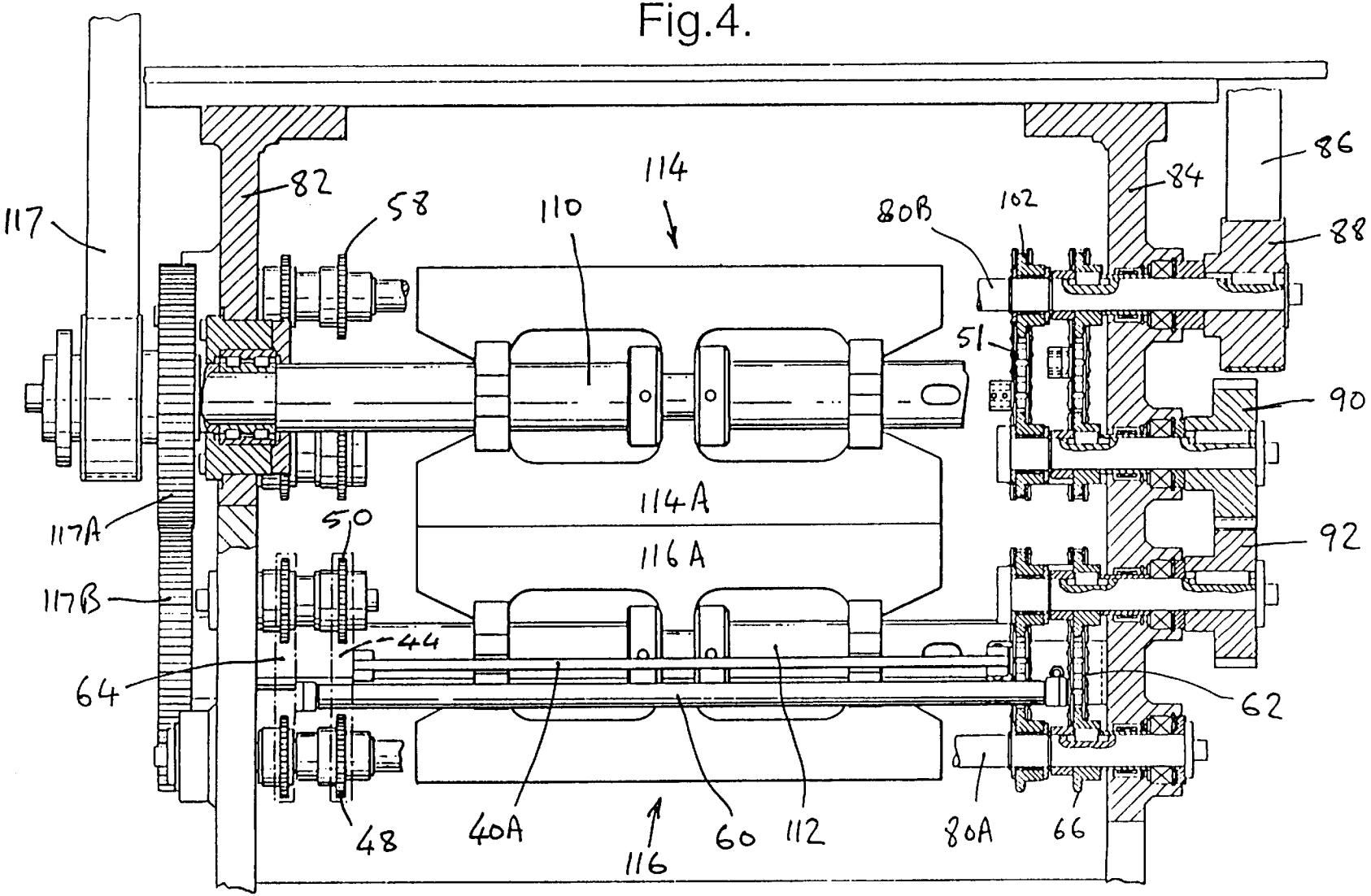
FIG. 4 is a partly sectioned plan view of the machine shown in FIG. 3.
Figure 5:
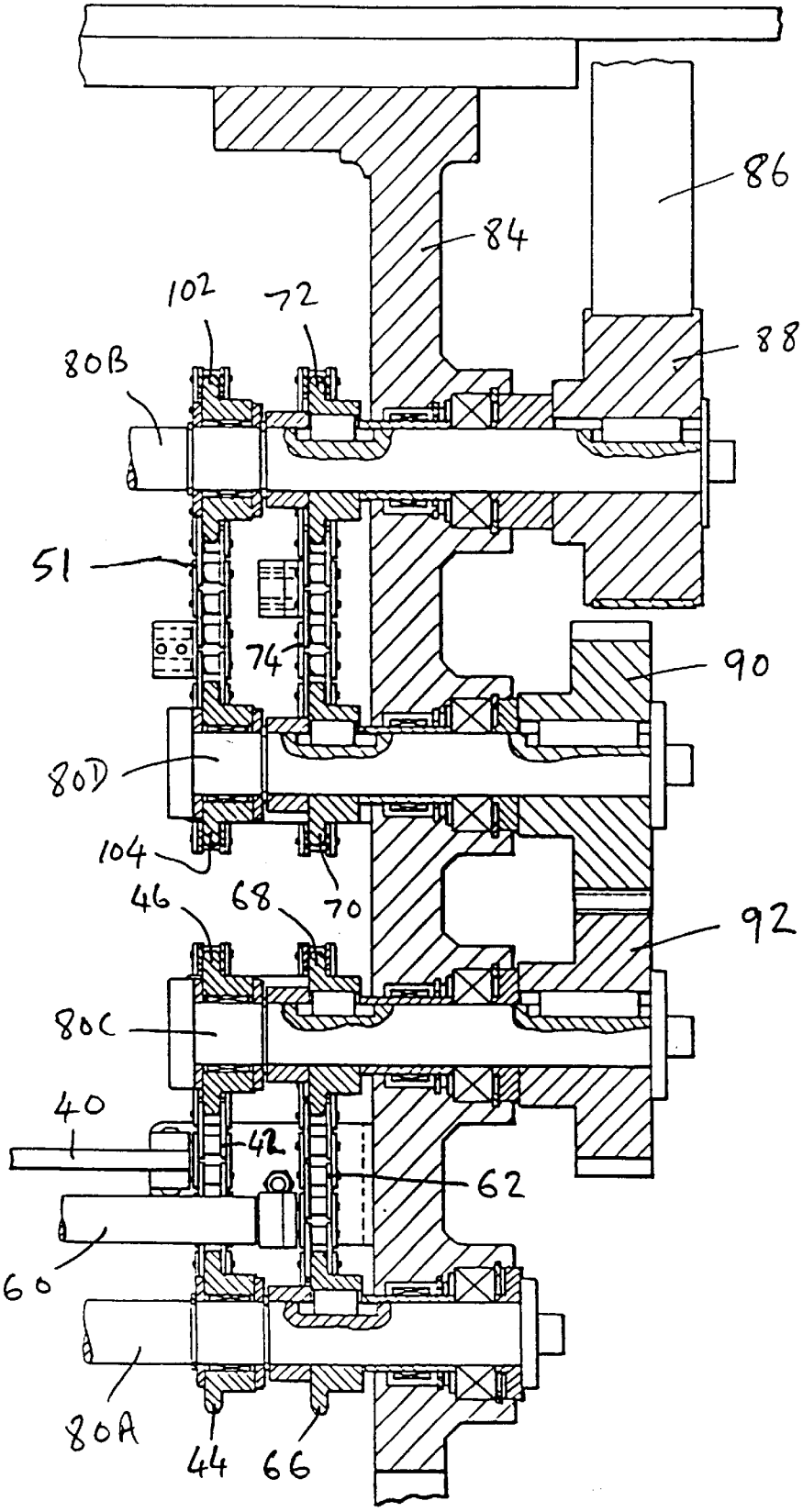
FIG. 5 is an enlarged section of the right-hand portion of the machine as viewed in FIG. 4.

With regard to the machine shown in FIGS. 3 to 5, FIG. 3 shows two pairs of stripping bars 40A–D in parked positions in which they can be left if stripping is not required. FIG. 3 (which omits certain parts for the sake of clear illustration) also shows one opposed pair of stripping bars in positions 40S and 40T in which they are about to commence their downward movement to cooperate with another in performing a stripping operation as described above with reference to the first example.

Each of the stripping bars is mounted at its opposite ends on two chains, for example chains 42 and 44 for the stripping bar 40A shown in FIGS. 4 and 5. Each chain passes around four sprockets mounted for rotation about horizontal axes at the four corners of a rectangle. Two upper sprockets 45 and 46 for the chain 42 are shown, as well as two upper sprockets 48 and 50 for the chain 44. The corresponding opposed stripping bar (FIG. 3) is similarly carried by chains of which only one chain 51 is shown passing around sprockets 102,104 in FIG. 4. Sprockets 56,58 for the other chain are shown in FIG. 4.

Immediately behind the stripping bar 40A as it moves towards the centre line of the machine (i.e. upwards as viewed in FIG. 4) is a product catching roll 60. This is mounted at it's opposite ends on chains 62 and 64 which run parallel to the chains 42 and 44. The chains 62 and 64 run respectively around four sprockets coaxial with the sprockets for the chains carrying the stripper bars. Sprockets 66 and 68 for the chain 62 are shown more clearly in FIG. 5, which also shows upper sprockets 70 and 72 for a corresponding chain 74 supporting one end of an opposed catching roll 76 (see FIG. 3).

The chain 64 (FIG. 4) with its corresponding sprockets forms essentially a mirror image of the arrangement shown in FIG. 5.

FIG. 3 shows the approaching stripping bars 40A,40B which will come together and cooperate at the position shown in dotted outlines 40S and 40T to commence the stripping action as described above. FIG. 3 also shows the additional stripping bars 40C,40D which are at that stage moving apart, followed by product catching rolls 78 and 80 carried by the outer pairs of chains 62,64 etc.

As they move downwards the chains are backed and supported by guide members 79 and 81.

The sprockets are mounted on several shafts of which two shafts 80A and 80B are shown (FIG. 4) extending from one side of the machine to the other and are mounted for rotation in bearings in side frame members 82 and 84. Additional short shafts are provided for other sprockets, for example, shafts 80C and 80D as shown in FIG. 5.

The chains carrying the product catching rolls are driven by a timing belt 86 passing around a pulley 88 mounted on the shaft 80B. the sprocket 72 for the chain 74 is keyed to the shaft 80B so that this chain in turn drives the shaft 80D via the sprocket 70 which is keyed thereto. This shaft is in turn connected to the shaft 80C via gears 90 and 92 and thus drives the shaft 80C (to which the sprocket 68 is keyed) and consequently also the shaft 80A to which the sprocket 66 is keyed. The shafts 80A and 80B in turn drive sprockets for the other chains 64 etc which support the product catching rolls on the other side of the machine.

The inner chains 42,44 etc carrying the stripping bars are driven by a timing belt 94 (FIG. 3) via a pulley 96 keyed to a shaft 98. As in the case of the outer chains for the product catching rolls, the shaft 98 driving the adjacent sprocket (not visible in the drawings) for a stripping bar chain also drives the corresponding sprocket and chain on the other side of the machine, and the other sprockets for the stripping bar chains are driven by various gears and an additional cross shaft (not shown) in essentially the same manner as is described above with respect to the chains and sprockets for the catching rolls.

With reference to FIG. 5, it will be appreciated that, while the sprocket 72 for the chain 74 is keyed to the shaft 80B, the sprocket 102 for the stripping bar chain 51 is instead mounted on the shaft 80B via a bearing. Similarly, each other sprocket in the machine is either keyed to the shaft carrying it or is mounted on a bearing as necessary to enable all the stripping bar and catching roll chains to be driven by independent motors driving respectively the belts 94 and 86.

Instead of two pairs of stripping and catching bars, there may be three or more.

Independent drives are provided partly so that the spacing between each stripping bar and its following catching roll can be varied during downward movement. Thus the catching rolls can initially lag behind the stripping bars to create a gap sufficient for the sealing jaws to pass between them, as necessary, the catching rolls being subsequently driven at a greater speed to reduce the gaps only after the cooperating sealing jaws on the sealing members (described below) have passed beyond the 9 o'clock/3 o'clock positions sufficiently to enable the catching rolls to pass through the gap between the sealing jaws. Moreover, separate electronically timed drives are provided for the chains and also for the sealing members to enable the distances between the successive horizontal seals on the packaging material to be varied in accordance with the desired lengths of the packets to be formed. The electronic drives also enable the stripping distance for each bag to be adjusted: that is to say, the distance along which the stripping bars move forwards with respect to and in close proximity to the packaging material to perform each stripping operation.

In order to ensure that, following stoppage of the machine, the various drives are appropriately timed with respect to one another before the feed of packaging material is re-started, shaft position encoders or independent sensors may be included to signal the positions of the various drives and thus enable their electronic controls to achieve the desired timing between 15 drives. This facility may include "cam" switches driven by the drives so as to make one revolution for each packet, with detectors for determining if the machine stops with any drive in a position (indicated by the corresponding "cam") indicating a potential clash between two or more components of the machine (sealers, strippers and catchers). In that case the drives can be initially driven by the electronic controller so as to be appropriately positioned relative to one another before the machine is brought fully into operation. During this start-up procedure the precise positions of the drives can be signalled to the electronic controller by detectors sensing the leading or trailing edge of each "cam" as it moves past the respective detector.

FIG. 4 shows two shafts 110 and 112 which carry respective rotary sealing members 114 and 116 and are mounted at their opposite ends for rotation in bearings in the side frames 82 and 84. Each of the sealing members has opposed (180° spaced) sealing jaws of which jaws 114A and 116A are shown in positions in which they are cooperating to form a seal in the packaging material (not shown). Thus the sealing members form two seals during each revolution. The sealing member 114 is driven by a timing belt 117, and the sealing member 116 is driven in the opposite direction and at the same speed via gears 117A and 117B.

FIG. 3 shows one end bearing 118 for the shaft 110, and an end bearing 120 for the shaft 112. A spring 122 (or set of springs) is provided to load the shaft 112 towards the shaft 110 so that an adjustable contact force between the sealing members is achieved during each sealing operation. The spring force is adjustable by means of a bolt 124.

Each of the sealing bars is electrically heated. Electrical power is applied to them for that purpose via fixed members 126 and 128 engaging slip rings (not shown) on the shafts.

FIG. 3 shows a chain tensioning member 130 which carries adjacent pairs of lower sprockets and is movable downwards to tension all four chains on one side of the machine. With this arrangement it will be understood that a similar arrangement would be provided for the chains on the other side of the machine. However, other ways of the tensioning the chains may alternatively be used to allow greater independence in the tensioning of each chain.

We claim:

1. A vertical form fill and seal packaging machine comprising a pair of sealing jaws cyclically movable to a sealing position at which said jaws engage a tubular packaging material so as to form horizontal seals across said tubular packaging material at regular intervals, a stripping device comprising first conveyors mounted for movement separately from and at a side of the sealing jaws and carrying cooperating parallel stripping bars which are arranged to be moved by the first conveyors on opposite sides of the packaging material such that said stripping bars cyclically sweep downwardly past said sealing position prior to and ahead of engagement of the packaging material by the sealing jaws to ensure that a product being packaged drops down past the sealing jaws before the jaws act to form each seal, and second conveyors mounted for movement separately from and at a side of the sealing jaws and carrying cooperating parallel product catching bars which are arranged to be moved by the second conveyors to a region above said sealing position as the sealing jaws form said seals so as to prevent product dropping prematurely into the area of the seal.

2. A packaging machine according to claim 1, comprising two conveyors for each stripping bar, said conveyors being arranged to support respective ends of the bars.

3. A packaging machine according to claim 2, comprising support members for said conveyors, and wherein said first and second conveyors are endless flexible devices which are arranged to be moved along closed paths around said support members.

4. A packaging machine according to claim 3, in which said endless flexible devices comprise chains.

5. A packaging machine according to claim 3, in which each first conveyor carries two or more stripping bars.

6. A packaging machine according to claim 3, in which the sealing jaws are mounted for rotation about respective horizontal axes, and in which said conveyors are arranged for moving the bars they carry along respective paths which extend around the axis of an adjacent one of the sealing jaws.

7. A packaging machine according to claim 1, comprising respective motors for driving said first conveyors, second conveyors and sealing jaws, and an electronic control arrangement for controlling said motors with respect to one another.

8. A packaging machine according to claim 7, wherein said control arrangement is such as to enable the stripping and product catching bars to be parked in positions away from the packaging material when stripping and catching are not required.

9. A vertical form fill and seal packaging machine comprising: two rotary sealing members; means for feeding tubular-formed packaging material along a downwardly extending path which passes between said rotary sealing members, which are disposed on opposite sides of said path and are arranged to cooperate to form horizontal seals at intervals along the packaging material between successive downward deliveries into a top opening of the packaging material of quantities of product to be packaged; and a product control arrangement comprising a pair of cooperating parallel stripping bars disposed one on each said side of said path, a pair of cooperating parallel product catching bars disposed one on each side of said path and respective endless flexible conveyors by means of which said stripping bars and catching bars are supported at each end of the bar, said flexible conveyors being mounted and drivable separately from the sealing members and the arrangement being such that each said bar is movable by a respective one of said flexible conveyors such that the bars are conveyed downwardly along said path and upwardly along a respective return path, which return paths are on the outside of the sealing member disposed on the same side of said downwardly extending path as the respective bars, and such that, when traveling downwardly along said downwardly extending path, said stripping bars cooperate to ensure that product being packaged drops down past the position at which a horizontal seal is to be formed before said sealing members act to form the seal, and said product catching bars operate to prevent product dropping into the region of said seal position before sealing has been accomplished.

10. A packaging machine according to claim 9, comprising respective shafts for said rotary sealing members, a support frame and respective bearings for each end of said shafts, in which bearings said ends are supported by said support frame, the arrangement being such that each flexible conveyor extends around the corresponding shaft near a said end thereof.

11. A packaging machine according to claim 9, wherein said stripping bars and product catching bars each have a longitudinal axis, and each said bar is mounted so as to be rotatable about its longitudinal axis.

12. A vertical form fill and seal packaging machine comprising a feed arrangement for feeding a generally tubular packaging material along a downwardly extending path, two sealing devices disposed one on each side of said path and being cyclically movable to a sealing position at which they engage said packaging material to form horizontal seals at desired intervals along the packaging material as the material is fed along said path, at least one stripping bar on each side of the path, respective conveyor arrangements for carrying said stripping bars, at least one product catching bar on each side of the path, and a drive motor for driving said sealing devices, said conveyor arrangements being mounted and drivable separately of said sealing devices and arranged for conveying the respective stripping bars along said path such that the stripping bars cooperate to sweep any of the product to be packaged from said sealing position, and said product catching bars being mounted so as to be driven with the sealing devices by the drive motor so as to engage said packaging material at a position upstream of said sealing position to prevent product dropping into said sealing position after stripping and prior to formation of the seal.

13. A packaging machine according to claim 12, wherein said stripping bars and product catching bars each have a longitudinal axis, and each said bar is mounted so as to be rotatable about is longitudinal axis.

14. A packaging machine according to claim 12, wherein said conveyor arrangements comprise endless flexible devices.

15. A packaging machine as claimed in claim 14, wherein said conveyor arrangements comprise respective flexible devices for carrying each end of said stripping bars.

16. A packaging machine as claimed in claim 14, wherein said flexible devices comprise chains.

17. A packaging machine as claimed in claim 12, comprising respective endless flexible devices for carrying said product catching bars, said flexible devices being mounted separately and drivable independently of said sealing jaws.

18. A packaging machine as claimed in claim 12, wherein said conveyor arrangements comprise endless flexible devices which carry said stripping bars, and a product catching bar is disposed on the same side of said path as the respective stripping bars.

19. A packaging machine as claimed in claim 12, wherein each conveyor arrangement carries a plurality of stripping bars.

20. A packaging machine as claimed in claim 19, comprising respective product catching bars associated with said stripping bars.

21. A vertical form fill and seal packaging machine comprising a feed arrangement for feeding a generally tubular packaging material along a downwardly extending path, two sealing devices disposed one on each side of said path and arranged to cooperate to form horizontal seals at intervals along the packaging material as the material is fed along said path, at least one stripping bar on each side of said path, respective conveyor arrangements for carrying said stripping bars, which conveyor arrangements are mounted and drivable separately of said sealing devices, independent drives for said sealing jaws and said conveyor arrangements, and control means for controlling said drives such that said conveyor arrangements are driven independently of said sealing jaws to convey the respective stripping bars downwardly along said path such that the stripping bars cooperate to sweep any of the product to be packaged from the region of a position at which a horizontal seal is to be formed when stripping is required and to move the stripping bars to predetermined parked positions away from the packaging material when stripping is not required.

22. A packaging machine as claimed in claim 21, wherein said independent drives include a motor for said sealing jaws and a motor for said conveyor arrangements and said control means includes electronic controls for controlling said motors with respect to one another.

23. A vertical form fill and seal packaging machine in which a tubular packaging material is fed along a downwardly extending feed path, said machine comprising a pair of sealing jaws, mounted on respective shafts which are disposed oppositely on respective sides of said feed path and are rotatable to cause said sealing jaws to cyclically engage said packaging material at a sealing position, for forming horizontal seals across the tubular packaging material at regular intervals; a stripping device comprising cooperating parallel stripping bars disposed one on each side of the feed path and carried by respective endless flexible conveyors which are mounted for movement separately from the sealing jaws and are disposed laterally of the respective sealing jaws such that said stripping bars are moved by said flexible conveyors around respective closed paths which extend around an axis of rotation of the said shaft disposed on the same side of the feed path as the respective flexible conveyors so as to cyclically sweep along opposite sides of the packaging material past said sealing position prior to engagement of the packaging material by the sealing jaws, to ensure that product being packaged drops down past the sealing jaws before the jaws act to form each seal; and a product catching device comprising cooperating product catching bars disposed one on each side of the feed path and carried by respective endless flexible conveyors mounted for movement separately of the sealing jaws and disposed laterally of the respective sealing jaws such that said product catching bars are moved by said flexible conveyors around respective closed paths which extend around an axis of rotation of the said shaft disposed on the same side of the feed path as the respective flexible conveyors so as to engage said packaging material upstream of said sealing position to prevent product dropping into said sealing position after stripping and prior to formation of the seal.

* * * * *